United States Patent [19]

Ray, Sr.

[11] 4,305,322

[45] Dec. 15, 1981

[54] STRINGED MUSICAL INSTRUMENT

[76] Inventor: Lester X. Ray, Sr., 100 8th Ave., Palmetto, Fla. 33561

[21] Appl. No.: 157,255

[22] Filed: Jun. 6, 1980

[51] Int. Cl.[3] ..... G10D 1/00

[52] U.S. Cl. ..... 84/173; D17/19; 84/291

[58] Field of Search ..... D17/14, 19; 84/173, 84/264, 265, 290, 291

[56] References Cited

U.S. PATENT DOCUMENTS

| | | | |
|---|---|---|---|
| D 205,601 | 8/1966 | Swagerty | D17/14 |
| 1,679,834 | 8/1928 | Lentz | 84/173 X |
| 4,242,938 | 1/1981 | Zalinge | 84/291 X |

*Primary Examiner*—Lawrence R. Franklin
*Attorney, Agent, or Firm*—Larson & Taylor

[57] ABSTRACT

A stringed musical instrument is disclosed in which the strings are stretched between the ends of an elongate curved bow member. The bow member is adapted to be held by the player with a side of the upper end against the cheek of the player. The playing strings are all attached to a peg at the lower end of the bow member and to tuning keys at the upper end of the bow member. When played, the vibrations caused by the playing strings are transferred to the cheek of the player such that the mouth of the player, when opened and shaped to various degrees and forms, constitutes not only a sound box but permits the playing of a tune. Where the bow member is flexible, a reinforcing member running from one end of the bow member to the other along the outside curved portion can be used to counteract the pulling force of the playing strings as they are tensioned. In this manner, the tuning of the playing strings can be maintained.

7 Claims, 6 Drawing Figures

STRINGED MUSICAL INSTRUMENT

FIELD OF THE INVENTION

This invention relates generally to a stringed musical instrument and more particularly to a stringed musical instrument which is noted or chorded with the mouth of the user.

BACKGROUND OF THE INVENTION

Probably the only musical instrument prior to the present invention in which the size and shape of the mouth is used to modulate the tone of the instrument is a Jew's harp. The basic design of a Jew's harp has been disclosed in prior U.S. patents, including U.S. Pat. No. 4,161,902 to Siverson. The tone which the mouth modulates is produced by a metal tongue which is struck by the fingers of the user. Another prior art device which uses the mouth of the user as a sounding box is disclosed in U.S. Pat. No. 527,675 to Enriquez. This musical instrument is played by picking the playing strings with the fingers, much like a guitar is played. The mouth of the user is placed against the back of the head of the instrument. As the fingers of one hand strum the strings, the fingers of the other hand are moved along the instrument pressing the strings against the proper frets to execute a tune on the strings. With the proper distension and contraction of the cheeks and movement of the lips of the performer together with a vibration of his tongue, an aeolian harmony to the sounds produced by the instrument is obtained.

In most stringed musical instruments, such as the common guitar and violin, a sound box located at one end of the instrument is used to project the various tones produced by the strings. However, other means of projecting sound have been disclosed in the prior art. For example, in U.S. Design Pat. No. 70,509 to Peroutek, a horn-like device is attached to one end of a stringed instrument to project the sound. In the device disclosed in U.S. Pat. No. 2,033,826 to Haium, a sound box is disclosed which is placed against the strings to project the sound.

A variety of shapes or designs of stringed musical instruments have also been disclosed in the prior art. For example, in U.S. Design Pat. No. 158,469 to Kohn, a violin having a bowed neck portion is disclosed. In order to increase the resonance for better tone quality in a stringed instrument, a second set of strings has been included in the musical instrument. For example, in U.S. Pat. No. 685,920 to Heck, a spring resonance device is located in the body of the stringed instrument. In U.S. Pat. No. 586,032 to Hartman, a second set of strings located along the length of the instrument is disclosed. An adjustable neck brace for a musical instrument which is used to counteract the warping caused by the strings is disclosed in U.S. Pat. No. 4,167,133 to Adams, Jr.

As shown by the prior patents cited above, there has been a constant striving in the art to produce stringed musical instruments having new and improved tone quality.

SUMMARY OF THE INVENTION

In accordance with the present invention, a stringed musical instrument is provided with an elongate bow member curved along the length thereof and a plurality of playing strings stretched between the ends of the elongate bow member. At one end of the elongate bow member, the playing strings are all attached to a common peg and then individually received in a bridge. At the other end, each string is individually attached to a separate adjustable key after passing through another bridge. The playing strings can be played by picking with the fingers or by a hair bow or the like. The sound vibrations produced by the playing of each string is a single note, and these vibrations are carried along a back wire running from the common peg at one end to a key at the other end along the outside curvature of the bow member. The strings may be tuned an octave apart. In use, the player places his open mouth against the bow member and the back wire so that his mouth acts as a sound box. By manipulating the size and shape of his open mouth, the player can alter the tone of the musical sound which is emitted from his mouth.

According to a preferred embodiment, a hollow box is located at each end of the elongate bow member. Mounted on each hollow box is the bridge and the peg or keys to tension the playing strings. The bridges on each hollow box can also be movable along a portion of the length of each hollow box. For better pickup of the sound vibrations from the playing strings, a metal plate or strip running along the outside length of the bow member can be provided. Small metal bridging heads projecting outward from the plate are then used to mount the back string in a spaced relationship from this plate.

Other features and advantages of the present invention are stated in or are apparent from the detailed description of preferred embodiments of the invention found hereinbelow.

DETAILED DESCRIPTION OF THE PREFERRED EMBODIMENTS

Figure 1:
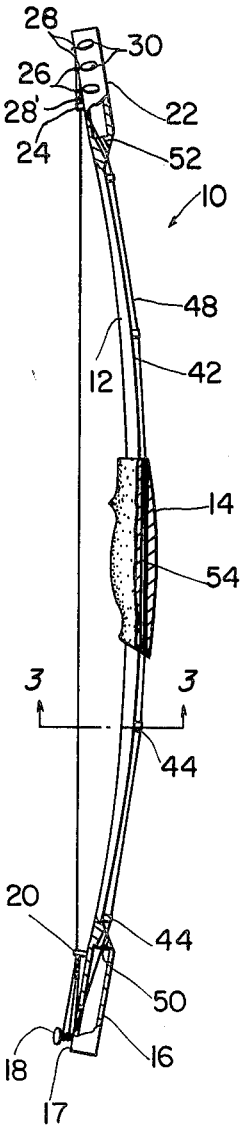
FIG. 1 is a partially sectioned side view of the stringed musical instrument of the present invention.
Figure 2:
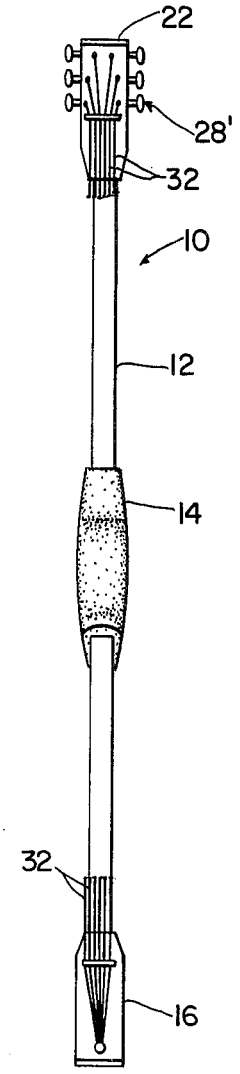
FIG. 2 is a rear view of the musical instrument depicted in FIG. 1.

With reference now to the drawings in which like numerals represent like elements throughout the several views, a presently preferred embodiment of the present invention is depicted in FIGS. 1 and 2 and comprises a stringed musical instrument 10 having an elongate bow member 12. At the center of elongate bow member 12 is a handle 14. At the lower end of elongate bow member 12 is a hollow box 16. Protruding from the inner face 17 of hollow box 16 is a peg 18 and a bridge 20. At the upper end of elongate bow member 12 is another hollow box 22. Protruding from the inner face 23 of hollow box 22 is a bridge 24 and the rotatable ends 26 of tuning keys 28. Tuning keys 28 are well known in the art and rotatable ends 26 are turned by rotation of wings 30.

One or more playing strings 32 are attached at one end to peg 18 and at the other end to individual keys 28. Playing strings 18 pass individually through bridges 20 and 24 at the respective ends of elongate bow member 12. Playing strings 32 are tensioned by tuning keys 28 to produce a desired tone. If more than one string is present, the strings can be tuned to be an octave apart, or, if less than an octave apart, the strings could be in harmony like a "C" and a "G." A variety of playing strings may be used, including guitar and banjo strings. While any number of strings of differing tones may be attached to musical instrument 10, in a preferred embodiment three pairs of strings are attached. The three pairs of strings in this preferred embodiment are the first (bass) string from a banjo, the fourth (tenor) string from a banjo, and between these two a pair of strings representing the tone between the first two mentioned strings. While each string 32 is individually tensioned by a key 28, it should be noted that all strings are commonly attached to peg 18.

Figure 3:
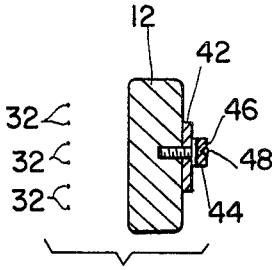
FIG. 3 is a cross-sectional view taken along the line 3—3 in FIG. 1.
Figure 4:
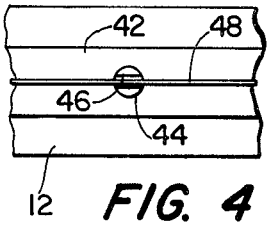
FIG. 4 is a front view of a portion of the bow member of FIG. 1.

With reference now to the additional FIGS. 3 and 4, a reinforcing member 40 located along the outside curvature of elongate bow member 12 is depicted. Reinforcing member 40 consists of a metal strip or plate 42 extending from hollow box 16 to hollow box 22 along the outside of elongate bow member 12. Protruding at spaced intervals along metal plate 42 are bridging heads 44. As shown in FIG. 3, bridging heads 44 have a V-shaped groove 46 which is aligned with the longitudinal length of elongate bow member 12. As shown in FIG. 1, a back wire 48 runs from peg 18 along the back of elongate bow member 12 to a tuning key 28'. Back wire 48 passes through a pipe 50 located in hollow box 16 without touching either pipe 50 or hollow box 16. Similarly, back wire 48 passes through a pipe 52 and hollow box 22 without touching either pipe 52 or hollow box 22. Along the length of elongate bow member 12, back wire 48 is located in the V-shaped grooves 46 of bridging heads 44 such that back wire 48 does not come in contact with metal plate 42. Both metal plate 42 and back wire 48 pass through an opening 54 in handle 14 such that back wire 48 does not touch either metal plate 42 or handle 14.

Figure 6:
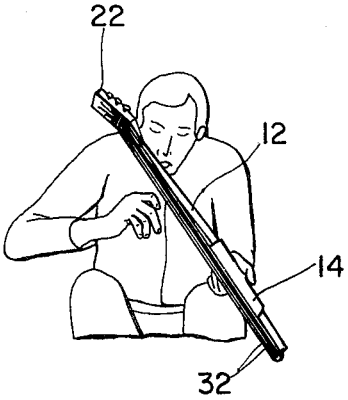
FIG. 6 is a perspective view of a user playing the musical instrument according to the present invention.

The operation of stringed musical instrument 10 is depicted in FIG. 6 and is as follows. Initially, playing strings 32 are tensioned by tuning keys 28 to the appropriate tones. If elongate bow member 12 is sufficiently flexible, back wire 48 may also be tensioned by key 28 to prevent further curvature of elongate bow member 12 as playing strings 32 are tensioned and to provide sufficient rigidity to ensure that the tuned strings will remain tuned. It should also be noted that back wire 48 may be tensioned or released in order to change the tone of playing strings 32 all at once. After the musical instrument 10 is appropriately tuned, the player 80 grasps handle 14 and positions an upper portion of elongate bow member 12 against the side of his cheek. Using his free hand, the player then picks at strings 32 or plays them with a hair bow such as a fiddle bow or the like. The sound vibrations produced by playing strings 32 are transferred to the surrounding air and to back wire 48, metal plate 42, and elongate bow member 12. The sound vibrations in instrument 10 are transferred through the check of the user so that the mouth acts as a sound box. Like a sound box, the mouth of the player acts to resonate and radiate the vibrations of the check. However, by changing the opening and shape of the mouth, the sound vibrations radiated from the mouth are noted or chorded to play a tune. As musical instrument 10 is played, the sound produced by the mouth of the player can be picked up by a microphone placed against the player's other cheek. Alternatively, both the sound produced by the mouth of the player and the tones produced directly by the strings can be heard simultaneously by a mike placed slightly away from the mouth of the user.

Figure 5:
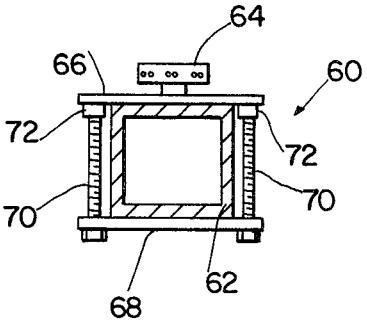
FIG. 5 is a cross-sectional view of an alternative embodiment of the present invention having a movable bridge.

Depicted in FIG. 5 is an alternative embodiment of the present invention having a movable bridge 60 mounted on a hollow box 62 located on one of the ends of elongate bow member 12. Movable bridge 60 consists of a bridge portion 64 mounted on a bridge base 66. On the opposite side of hollow box 62 is a lower base 68. Two threaded screws 70 pass through lower base 68 into thread receiving portions 72 connected to bridge base 66. By movement of threaded screws 70, bases 66 and 68 can be clamped anywhere along hollow box 62 to locate bridge portion 64 as desired.

It should be noted that a variety of different materials can be used to construct bow member 12. It is anticipated that a bow member 12 made of wood would produce the best sound. However, other materials such as fiberglass, metal, and others may also be used so long as these materials are made rigid enough or reinforced to maintain the playing strings in the proper tuned tension. It should also be appreciated that while in the preferred embodiment the cheek of the player is pressed against the upper side of bow member 12, the cheek of the player cana be pressed anywhere against the side of bow member 12 to pick up the sound vibrations. The sound produced by musical instrument 10 depends not only upon the tuning of the playing strings but on the type of playing string used. For example, a bass guitar string would produce a different sound from a bass banjo string.

A musical instrument according to the present invention has been tried experimentally by applicant. With this model and with one string, it has been shown that the sound produced by manipulating the mouth can be varied by more than an octave.

It should be appreciated that the present invention functions in contradistinction to the usual stringed instrument. In a usual stringed instrument, the tones of the playing strings are varied by effectively shortening them by pressing them against spaced frets. Additionally, in the usual stringed instrument, the variety of tones produced by the playing strings are resonated and radiated by a sound box located just below the strings (like the hollow body of a violin). However, the present invention utilizes variations in the size and shape of the sound box (the player's mouth) to produce varying tones from the single wavelength vibrations produced by each vibrating playing string. These varying tones are also resonated and radiated by the player's mouth regardless of shape and size. With one string, the music produced will consist of the tone of the single string as plucked or bowed as well as the tones produced by varying the size and shape of the mouth opening. Where more than one string is played, the strings should be tuned an octave apart so as to produce a major chord.

Although the invention has been described in detail with respect to exemplary embodiments thereof, it will be understood by those of ordinary skill in the art that variations and modifications can be effected within the scope and spirit of the invention.

I claim:

1. A stringed musical instrument comprising, an elongate curved bow member adapted to be held by the player with a side of the upper end against the cheek and at least one playing string joined to said bow member near the lower end of said bow member by a peg, near the upper end of said bow member by a tuning key, and extending across the bight of said bow member, whereby the vibrations caused by the playing of said playing strings are transferred to the cheek of the player such that the mouth of the player when opened and shaped to various degrees and forms plays a tune, the mouth of the player also acting simultaneously as a sound box to resonate and radiate the tune produced.

2. A stringed musical instrument as claimed in claim 1, further including a hollow box at each end of said bow member on which said peg and said tuning keys are mounted.

3. A stringed musical instrument as claimed in claims 1 or 2, wherein said bow member is flexible and further including a reinforcing member running from one end of said bow member to the other end along the outside curved portion of said bow member, said reinforcing member acting to counteract the pulling force of said playing strings so that said strings remain tuned at a desired tension.

4. A stringed musical instrument as claimed in claim 3 wherein said reinforcing member includes a back wire stretched between said peg and a tensioning key located at the other end of said bow member.

5. A stringed musical instrument as claimed in claim 4 wherein said reinforcing member further includes a metal plate located along the outside length of said bow member and bridging heads spaced along said plate in which said back wire is mounted, said bridging heads acting to raise said back string slightly above and out of contact with said metal plate.

6. A stringed musical instrument as claimed in claim 1 further including a handle located on said bow member.

7. A stringed musical instrument as claimed in claim 1 further including a movable bridge for said playing strings located at each end of said bow member.

* * * * *